United States Patent [19]

Wakamiya et al.

[11] Patent Number: 4,656,111

[45] Date of Patent: Apr. 7, 1987

[54] PRESSURE-FIXABLE TONER COMPRISING COMBINATION OF A COMPOUND HAVING HYDROCARBON CHAIN AND A COMPOUND HAVING AMINO GROUP

[75] Inventors: Katsutoshi Wakamiya, Yokohama; Toru Matsumoto, Tokyo; Masuo Yamazaki, Kawasaki, all of Japan

[73] Assignee: Canon Kabushiki Kaisha, Tokyo, Japan

[21] Appl. No.: 693,468

[22] Filed: Jan. 22, 1985

Related U.S. Application Data

[63] Continuation-in-part of Ser. No. 598,915, Apr. 10, 1984, abandoned.

[30] Foreign Application Priority Data

| | | | |
|---|---|---|---|
| Apr. 12, 1983 | [JP] | Japan | 58-63931 |
| Jul. 7, 1983 | [JP] | Japan | 58-124026 |
| Jul. 7, 1983 | [JP] | Japan | 58-124027 |

[51] Int. Cl.[4] ..... G03C 9/00; G03C 13/20

[52] U.S. Cl. ..... 430/109; 430/98; 430/110

[58] Field of Search ..... 430/109, 98, 110

[56] References Cited

U.S. PATENT DOCUMENTS

| | | | |
|---|---|---|---|
| 3,788,994 | 1/1974 | Wellman | 430/109 |
| 3,925,219 | 12/1975 | Strong | 430/109 |
| 3,928,656 | 12/1975 | Strella et al. | 430/109 X |
| 4,107,062 | 8/1978 | Tomono et al. | 430/109 |
| 4,108,653 | 8/1978 | Peters | 430/109 X |
| 4,407,922 | 10/1983 | Grushkin et al. | 430/109 X |

FOREIGN PATENT DOCUMENTS

| | | | |
|---|---|---|---|
| 0036243 | 4/1978 | European Pat. Off. | 430/109 |
| 0005334 | 11/1979 | European Pat. Off. | 430/109 |
| 0066395 | 8/1982 | European Pat. Off. | 430/109 |

*Primary Examiner*—John E. Kittle
*Assistant Examiner*—Mukund J. Shah
*Attorney, Agent, or Firm*—Fitzpatrick, Cella, Harper & Scinto

[57] ABSTRACT

A pressure-fixable toner comprising a combination of a compound A having a hydrocarbon chain and a compound B having an amino group in addition to a hydrocarbon chain is excellent in dispersibility of colorant, pressure fixing characteristic and developing characteristic. Further, an encapsulated pressure-fixable toner comprising a core of the pressure-fixable toner particles and a shell encapsulating the core is also excellent in these properties.

32 Claims, No Drawings

PRESSURE-FIXABLE TONER COMPRISING COMBINATION OF A COMPOUND HAVING HYDROCARBON CHAIN AND A COMPOUND HAVING AMINO GROUP

CROSS REFERENCE TO THE RELATED APPLICATION

This application is a continuation-in-part of application Ser. No. 598,915 filed Apr. 10, 1983, now abandoned.

BACKGROUND OF THE INVENTION

1. Field of the Invention

This invention relates to a toner to be used for electrophotography, electrostatic printing, magnetic recording or electrostatic printing, particularly to a toner suitable for pressure fixing.

2. Description of the Prior Art

The operation of the so called "fixing" has heretofore been practiced when electrostatic latent image or magnetic latent image is desired to be developed with colored powder called "toner" and to store the resultant image thereafter. As such fixing methods are known a method in which the toner image on the latent image bearing member surface is fixed or attached as such, or after transferred onto a transfer member, by melting the toner in a heat chamber, a method in which the toner is pressure bonded onto a support simultaneously with melting by means of hot rollers, and a method in which toner is attached by dissolving it in a solvent and thereafter removing the solvent.

When heat is used as described above, for utillizing more effectively the heat, it is sometimes practiced to use flash exposure, IR-ray exposure, induction heating or a combination of these. However, there is a limit to substantial improvement in efficiency, and the heat quantity required per sheet is the same. Accordingly, when fixing is desired to be performed at a higher speed, there is no way but to supply greater amount of heat. In these days, when techniques are highly progressed, and image information is also required to be transmitted at high speed with diversification and speed-up of information, the fixing time for storage of image information is demanded to be very short. In compliance with such a demand, under the present situation, a fixing device having a gigantic heating source is employed.

As contrasted to the fixing methods known in the art as described above, as a fixing method attracting attention recently, there is a fixing method called the pressure fixing method in which image is fixed only by pressure. This method enables fixing only by pressure and therefore has an advantage of obviating the operation to give heat as required in other methods of the prior art, but its still greater advantage is "requiring little time for fixing". That is, pressure fixing is effected momentarily when the image passes through the pressure rollers. In the pressure fixing, fixing is effected by only pressure, and such a time consuming step as melting or vaporization is not required at all. It may well be natural to consider that the pressure fixing method will be promising as a means for higher speed fixing, for the reasons as mentioned above.

However, in spite of great advantages as mentioned above, the pressure fixing method known in the art involves some vital drawbacks. One of them is the pressure required for fixing, which is generally 20 to 75 kg/cm in terms of line pressure. For application of such a force, the fixing device is required to have a considerable strength, to make the fixing device undesirably large and heavy. Another drawback is that it is extremely and essentially difficult to apply a pressure as mentioned above evenly on an image on a transfer paper, whereby it is very difficult to prevent the transfer paper from creasing or curling. Further, when a pressure as mentioned above is applied on the image by rollers, the image surface will be flattened to give rise to lustre on the image and lower the quality of image. Also, since the fixing characteristic depends greatly on the line pressure and the properties of the fixing substrate on which toner is fixed, the fixing characteristic may be changed if, for example, the width of the paper is changed or the transfer paper is changed in the same fixing device. This is also a serious drawback experienced as a trouble in practical application. Actually, it has been attempted to circumvent these problems in one way or another, and some of them are actually put into practice. For example, for removing lustre, fixing rollers are made matte, or for application of uniform pressure, a crossing angle is provided between the rollers. However, even by recourse to such methods, other problems are caused instead. For example, the matte roller itself will be returned to a flat roller due to large fixing pressure, or crease tends to develop more readily due to the crossing angle.

SUMMARY OF THE INVENTION

An object of the present invention is to provide a pressure-fixable toner which is excellent in developing characteristic and pressure fixing characteristic.

Another object of the present invention is to provide a pressure-fixable toner which is little influenced by change in fixing speed and is particularly suitable for high speed fixing.

Still another object of the present invention is to provide a pressure-fixable toner which is little influenced by change in fixing pressure and can be fixed even under a low pressure.

It is also another object of the present invention to provide a pressure-fixable toner with little change in fixing characteristic by difference in fixing substrate.

A further object of the present invention is to provide a toner which will change little in developing characteristic even when employed for a large number of times.

The pressure-fixable toner of the present invention has been developed in order to accomplish the above objects and comprises a compound A having a hydrocarbon chain, and a compound B containing an amino group (inclusive of primary, secondary and tertiary amino groups) in addition to a hydrocarbon chain.

According to another aspect of the present invention, there is provided a pressure-fixable toner, comprising a compound A of $C_{12}$ or more than $C_{12}$ having an aliphatic hydrocarbon chain of $C_{12}$ or more than $C_{12}$ and an amino compound $B_1$ having a hydrocarbon chain of $C_{10}$ to $C_{31}$, the amino compound $B_1$ being added in an amount of 0.01 to 3.0 weight % based on the compound A.

According to still another aspect of the present invention, there is provided a pressure-fixable toner, comprising 100 parts by weight of a compound A of $C_{12}$ or more than $C_{12}$ having a hydrocarbon chain of $C_{12}$ or more than $C_{12}$ and more than 10 parts by weight of a compound $B_2$ having a hydrocarbon chain and an amino group, the compound $B_2$ being obtained by graft copolymerizing a compound having a an aliphatic hydrocarbon chain of $C_{12}$ or more than $C_{12}$ with an amino group-containing monomer represented by the following formula

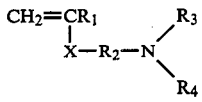

wherein:

X: a group linking a carbon of the main chain to $R_2$;

$R_2$: a lower alkylene;

$R_1$: hydrogen or a lower alkyl;

$R_3$, $R_4$: hydrogen, a lower alkyl or an aryl.

According to a further aspect of the present invention, there is provided an encapsulated pressure-fixable toner, comprising a core and a shell encapsulating the core in which the core comprises a compound A of $C_{12}$ or more than $C_{12}$ having an aliphatic hydrocarbon chain of $C_{12}$ or more than $C_{12}$ and an amino compound $B_1$ having a hydrocarbon chain of $C_{10}$ to $C_{31}$, the amino compound $B_1$ being added in an amount of 0.01 to 3.0 weight % based on said compound A.

According to a still further aspect of the present invention, there is provided an encapsulated pressure-fixable toner, comprising a core and a shell encapsulating said core, in which the core comprises 100 parts by weight of a compound A of $C_{12}$ or more than $C_{12}$ having a hydrocarbon chain of $C_{12}$ or more than $C_{12}$ and more than 10 parts by weight of a compound $B_2$ having a hydrocarbon chain and an amino group, the compound $B_2$ being obtained by graft copolymerizing a compound having a an aliphatic hydrocarbon chain of $C_{12}$ or more than $C_{12}$ with an amino group-containing monomer represented by the following formula

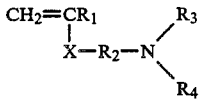

wherein

X: a group linking a carbon of the main chain to $R_2$;

$R_2$: a lower alkylene;

$R_1$: hydrogen or a lower alkyl;

$R_3$, $R_4$: hydrogen, a lower aklyl or an aryl.

According to a further aspect of the present invention, there is provided a pressure-fixable toner comprising compound $B_2$, as a binder resin, obtained by graft copolymerizing a compound having an aliphatic hydrocarbon chain of $C_{12}$ or more than $C_{12}$ with an amino group-containing monomer represented by the following formula

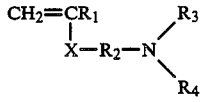

wherein

X: a group linking a carbon of the main chain to $R_2$;

$R_2$: a lower alkylene;

$R_1$ : hydrogen or a lower alkyl;

$R_3$, $R_4$: hydrogen, a lower alkyl or an aryl.

According to a still further aspect of the present invention, there is provided an encapsulated pressure-fixable toner, comprising a core and a shell encapsulating the core, in which the core comprises a compound $B_2$ obtained by graft copolymerizing a compound having an aliphatic hydrocarbon chain of $C_{12}$ or more than $C_{12}$ with an amino group-containing monomer represented by the following formula

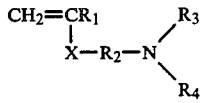

wherein:

X: a group linking a carbon of the main chain to $R_2$;

$R_2$: a lower alkylene;

$R_1$ : hydrogen or a lower alkyl;

$R_3$, $R_4$: hydrogen, a lower alkyl or an aryl.

A remarkable characteristic feature of the toner thus constituted is that it has a particularly excellent dispersibility of a pigment, as compared with the toner of the prior art. This is because the compound B having a hydrocarbon chain and an amino group has an extremely good compatibility with the compound A having a hydrocarbon chain and also has good affinity for a pigment. Thus, dispersion can be effected easily even in the combination of a pigment and a compound having a hydrocarbon chain in which the pigment can be poorly dispersed in the prior art. While the improvement may be attributable to improved dispersion of the pigment, the toner of the present invention is further excellent particularly in mechanical strength, satisfactory in pressure fixing characteristic and sufficient in developing characteristic, with the change in developing characteristic being small even used for a large number of times. The fixing characteristic is also excellent and does not change depending on the speed, paper quality, etc.

DETAILED DESCRIPTION OF THE INVENTION

The compound A having a hydrocarbon chain of $C_{12}$ or more than $C_{12}$ (i.e., having 12 or more carbon atoms), which is one of the main components in the toner of the present invention, is an organic compound of $C_{12}$ or more than $C_{12}$ such as hydrocarbons, fatty acids and esters or metal soaps thereof, fatty alcohols, polyvalent alcohols and metal salts or chlorides, fluorides thereof, amides, bisamides and polymers and copolymers having the same structures in the structural units, and polyolefine polyethylene, polypropylene, etc. These are commercially available as single substances or mixtures. In general, there are known polyethylene, polypropylene, paraffin wax, microcrystalline wax, montan wax, ceresin wax, ozocerite, carnauba wax, rice wax, shellac wax, Sazol wax, metal soap, amide wax, etc.

Trade names with manufacturers may include Paraffin Wax (Nippon Sekiyu K.K.), Paraffin Wax (Nippon Seiro K.K.), Microwax (Nippon Sekiyu K.K.), Microcrystalline Wax (Nippon Seiro K.K.), Hoechst Wax (Hoechst AG), Diamond Wax (Shinnippon Rika K.K.), Santite (Seiko Kagaku K.K.), Panasate (Nippon Yushi K.K.), and others.

Polyethylene can be obtained according to a polymerization method as disclosed in, for example, Japanese Patent Publication No. 524/1965. Further, decomposition products of such polyethylene according to a method as disclosed in, for example, Japanese Patent Publication No. 524/1965 are also included. These are generally commercially available as polyethylenes for blow molding, inflation film or injection molding and low molecular weight polyethylenes or polyethylene wax, and they are manufactured and sold by Hoechst AG, Celanese Plastics, Philips Petroleum Co., National Petrochemical Corp., Union Carbide Corp., British Hydrocarbon Chemicals Ltd., Furukawa Kagaku K.K., Mitsui Sekiyu Kagaku K.K., Showa Denko K.K., Chisso K.K. and others.

Representative grades of paraffin wax for example, are shown in the following Table.

Paraffin Wax and Microwax (produced by Nippon Sekiyu K. K.)

| Name | Melting point °C. |
|---|---|
| Nisseki No. 1 Candle Wax | 59.7 |
| Nisseki No. 2 Candle Wax | 62.0 |
| 125° Paraffin | 54.3 |
| 130° Paraffin | 56.5 |
| 135° Paraffin | 59.7 |
| 140° Paraffin | 61.9 |
| 145° Paraffin | 63.2 |
| 125° FD Paraffin | 53.8 |
| Paraffin Wax (M) | 54.1 |
| 125° Special Paraffin | 54.2 |
| Nisseki Microwax 155 | 70.0 |
| Nisseki Microwax 180 | 83.6 |

Paraffin Wax (produced by Nippon Seiro K. K.)

| Name | m.p. | Name | m.p. |
|---|---|---|---|
| 155 | 70 | SP-0145 | 62 |
| 150 | 66 | SP-1035 | 58 |
| 140 | 60 | SP-1030 | 56 |
| 135 | 58 | SP-3040 | 63 |
| 130 | 55 | SP-3035 | 60 |
| 125 | 53 | SP-3030 | 57 |
| 120 | 50 | FR-0120 | 50 |
| 115 | 47 | | |

other examples are:

Hoechst Wax OP (partially saponified ester wax of montanic acid, produced by Hoechst AG);

Hoechst Wax E (ester wax of montanic acid, produced by Hoechst AG);

Hoechst Wax $GL_3$ (partially saponified synthetic wax, produced by Hoechst AG);

Panasate S-218 (Nippon Yushi K.K.);

Sparmaceti (Nippon Yushi K.K.);

Nissan Castor Wax (Nippon Yushi K.K.); and

Olimeth H (Kawaken Fine Chemical K.K.).

As the amide waxes, there may be included the following examples.

Saturated fatty acid amide type behenic acid amide: Diamide(Nippon Suiso K.K.)

stearic acid amide:
- Armide HT (Lion Yushi K.K.)
- Amide S (Nitto Kagaku K.K.)
- Amide T (Nitto Kagaku K.K.)
- Bisamide (Nitto Kagaku K.K.)

Methylenebisoleic acid amide: Lublon O (Nippon Suiso K.K.)

Ethylenebisstearic acid amide: Armowax EBS (Lion Armor K.K.)

Ethylenebisoleic acid amide

Hexamethylenebisstearic acid amide: Amide (Kawaken Fine Chemical K.K.)

Hexamethylenebisoleic acid amide: Amide (Kawaken Fine Chemical K.K.)

Octamethylenebiserucic acid amide

Monoalkylol amide

N-(2-hydroxyethyl)lauric acid amide:
- Tohol N 130 (Toho Kagaku K.K.)
- Amizol LME N-(2-hydroxyethyl)erucic acid amide N-(2-hydroxyethyl)stearic acid amide: Amizol (Kawaken Fine Chemical K.K.)

N-(2-hydroxyethyl)oleic acid amide.

N-(2-hydroxymethyl)stearic acid amide: Methylolamide (Nitto Kagaku K.K.).

As commercially available polymeric materials, there are various grades such as AC polyethylene of Allied Chem. Co., Sunwax of Sanyo Kasei K.K., Hoechst Wax of Hoechst AG, Hiwax of Mitsui Sekiyu Kagaku K.K., A Wax of BASF, DQOJ of NUC, ELVAX of Mitsui Polychemical K.K. and Shodex of Showa Yuka K.K.. Examples of polyethylene wax are AC#1702, AC#617, AC#6, AC#7, AC#8, AC#9 and AC#615 produced by Allied Chem. Co.; Sunwax 171P, 151P, 131P, 161P and 165P produced by Sanyo Kasei K.K.; Hoechst Wax PE130, PE190 and PA520 produced by Hoechst AG; Hiwax 110P, 210P, 220P, 310P, 320P, 200P, 410P, 405P and 400P produced by Mitsui Sekiyu Kagaku K.K.; BASF A Wax and AM Wax produced by BASF. As oxidized polyethylene, there are AC629, AC655, AC680, AC690, AC392, Sunwax E300, Hiwax 4202E, 4053E, Hoechst PAD521, PAD522, etc.

It is also possible to use other polymeric materials such as Sholex 6050, 6200, 5050, 5080, 5220, F6050V produced by Showa Yuka K.K., Hizex 1200J, 2100J, 2200J, 5100J produced by Mitsui Sekiyu Kagaku K.K., Stafren E601, E650, E670 produced by Furukawa Kagaku K.K., Mirason Ue023H, ACe30N, FL60, FL67 produced by Mitsui Polychemical, and others.

In the present invention, polyethylene and the compound A other than polyethylene may be used suitably in combination. Of course, if necessary, several kinds of compounds A may be used in combination. In this case, the formulation ratio of polyethylene to the compound A may be 80/20 to 1/99 by weight, preferably 70/30 to 5/95.

The compound B having a hydrocarbon chain and an amino group, which is another main component in the present invention, includes several types.

The first type is an amino compound $B_1$ which is typically linear as represented by the following formulae:

$$R_1—NH_2$$

$$NH_2—R_2—NH_2$$

$$NHR'—R_2—NH_2$$

$$R_1—NH—R_3$$

$$R''\text{-}(R_2—NH)_nR'''; \quad m=1 \text{ or more than } 1$$

wherein:

$R_1$: $\text{-}(CH_2)_{n1}CH_3$; $n_1=9\text{–}30$ $R_2$: $\text{-}(CH_2)_{n2}$; $n_2=10\text{–}30$ $R_3$: $\text{-}(CH_2)_{n3}CH_3$; $n_3=1\text{–}30$ R', R'', R''': substituent, for example various organic functional groups such as alkyl, polybutenyl and polybutenyl succinic acid groups.

As typical examples, the following compounds are shown:

$H_2N—C_4H_8—NH—(CH_2)_9CH_3$, $CH_3(CH_2)_{13}—NH—C_3H_6—NH_2$, $CH_3(CH_2)_{17}—NH—C_3H_6—NH_2$

Such a compound may be prepared, for example, by reacting a primary amine with acrylonitrile and then hydrogenating the reaction product. The amino compound $B_1$ having such a hydrocarbon chain of $C_{10}$ or more than $C_{10}$ may be added in an amount of about 0.01 to 3.0% based on the compound A.

The compound B having a hydrocarbon chain and an amino group can also be obtained as a compound $B_2$, which is prepared by graft copolymerizing an amino group-containing monomer represented by the formula shown below onto a compound of $C_{12}$ or more than $C_{12}$ having a hydrocarbon chain of $C_{12}$ or more than $C_{12}$ as described above for the compound A:

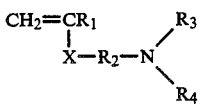

wherein:

X: a group linking a carbon of the main chain to $R_2$:

$R_2$: a lower alkylene ($C_1$ to $C_5$);

$R_1$: hydrogen or a lower alkyl ($C_1$ to $C_5$);

$R_3$, $R_4$: hydrogen, a lower alkyl ($C_1$ to $C_5$) or an aryl.

Examples of the monomers represented by the above general formula are:

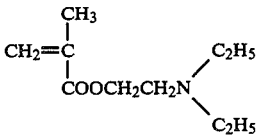

(1)

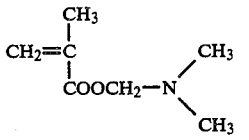

(2)

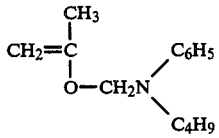

(3)

Other vinyl monomers can also graft copolymerized together with the above amino group-containing monomer. Such vinyl monomers include styre, α-methylstyrene, divinylbenzene, t-butylstyrene, acrylic acid esters, methacrylic acid esters, acrylonitrile, methacrylonitrile, vinyl acetate, vinyl pyridine and the like.

These graft monomers may be used preferably in an amount of 0.1 to 40, particularly 0.1 to 20, parts by weight per 100 parts by weight of the base material of a compound having a hydrocarbon chain, and 20% by weight or more, of the amount should preferably be the amino group-containing monomer.

For graft copolymerization or co-graft copolymerization of the above monomer onto the base material of a compound having a hydrocarbon chain of $C_{12}$ or more than $C_{12}$, various methods known in the art may be used. For example, the method using bulk polymerization, the solution graft polymerization method using a solvent, the emulsion polymerization method carrying out polymerization in an emulsion system and the suspension polymerization method may be employed.

In bulk polymerization, the base material is dissolved in the monomer, while in solution polymerization in a solvent such as benzene, toluene, xylene, etc., before initiation of polymerization by the action of an initiator. In emulsion polymerization, the base material is previously emulsified, and the polymerization reaction is carried out.

On the other hand, in the suspension polymerization method, particles of a base material are dispersed in an aqueous system containing a stabilizer and a dispersant dispersed therein, and the monomer is also suspended in water to carry out polymerization. The base material may be swelled with the monomer previously by heating before initiation of polymerization.

Structly speaking, the graft-copolymerization product thus obtained is not a pure graft copolymer. That is, it is a mixture of the base material polymer, the graft polymer and the homopolymer of the monomer employed. Nevertheless, it has sufficient performance for accomplishing the object of the present invention.

In the present invention, these and purified graft copolymers are called comprehensively as the graft copolymerized compound $B_2$.

Above all, when graft copolymerization is conducted in a suspension system in water, the grafted product obtained is particularly homogeneous. Therefore, particularly when employed as the toner, its performance is excellently stable. For example, even when the environmental conditions during use may be changed, its characteristics will not be changed to a great extent, and there will be little change when left to stand for a long time. Besides, the toner employing the grafted product prepared according to such a method can give a large number of copies of substantially the same quality stably, particularly when used repeatedly for a large number of times.

The graft copolymerized compound $B_2$ thus obtained should preferably be used in an amount of more than 10, parts by weight, preferably 10 to 900 parts by weight, particularly preferably 10 to 90 parts by weight, per 100 parts by weight of the compound A having a hydrocarbon chain.

As the binder resin in the present invention, in addition to the compounds A and B, other known resins may be mixed therein. For example, polyester resin, epoxy resin, silicone resin, polystyrene, polyamide resin, polyurethane resin and acrylic resin may be used. But the amount of such a resin should not exceed 30% by weight of the total binder resin.

As the colorant to be used in the toner of the present invention, all of the known colorants may be available, including, for example, carbon black, iron black, nigrosine, Benzidine Yellow, quinacridone, Rhodamine B, Phthalocyanine Blue, etc.

In order for the toner of the present invention to be used as a magnetic toner, magnetic powder may be incorporated therein. As such magnetic powder, it is possible to use a material which can be magnetized when placed in a magnetic field. For example, there is powder of strongly magnetic metal such as iron, cobalt, nickel, etc. or a compound such as magnetite, hematite or ferrite. The magnetic powder may be contained in an amount of 15 to 70% by weight based on the toner weight.

The magnetic toner of the present invention may also contain additives for various purposed. As such additives, there are charge controllers such as metal complexes, nigrosine, etc., compounds having lubricant property such as polytetrafluoroethylene, plasticizers such as dicyclohexylphthalate and the like.

Further, the toner (or encapsulated toner) of the present invention may be mixed with carrier particles such as of iron powder, glass beads, nickel powder or ferrite powder to be used as a developer for electrostatic latent images. Also, for the purpose of improving the free flowing property of powder, hydrophobic colloidal fine silica particles may be mixed with the toner. Further, for prevention of toner attachment, fine particles of a polishing agent may be mixed with the toner.

The first characteristic feature of the pressure-fixable toner thus constituted is that it can be fixed under a low pressure. In fact, it can be fixed under a pressure (10 to 15 kg/cm) of $\frac{5}{8}$ to 1/5 of the pressure conventionally employed in the prior art. Further, there are some important specific features. One of them is small dependency on the fixing device. In the prior art, for performing pressure fixing, it has been required to apply a strong pressure locally with a contact area as small as possible. Therefore, with the use of rigid rollers, it was difficult to obtain stability or strength for the members for holding such rollers, and sometimes problems occurred in enlargement of the device and durability. In contrast thereto, the pressure-fixable toner in the present invention, which itself exhibits self-agglomerating characteristic under a certain pressure, can be fixed without no such locally strong force, since an amino group is suitably provided with the compounds $B_1$ and $B_2$. Accordingly, for example, pressure rollers having somewhat elasticity can be also practically used.

Further, still another great advantage possessed by the pressure-fixable toner of the present invention is very little dependency on the surface to be fixed. It has been well known in the art that the pressure fixability will differ greatly depending on the surface to be fixed. However, it is practically most preferable to have equal fixability on any surface. Thus, the present invention enables complete PPC pressure fixing, which has been impossible with the use of pressure-fixable components of the prior art.

Further, still another characteristic feature of the pressure fixable toner of the present invention is small dependency of the fixing force on the fixing speed. As described previously, pressure fixing, as compared with the thermal fixing of the prior art, proved to be a fixing method with smaller dependency on fixing speed. However, with the use of the pressure-fixable components of the prior art, dependency on the fixing speed cannot be made zero, but somewhat additional pressure was required for performing fixing at a high speed. In contrast, when the toner of the present invention is employed, almost no dependency on the fixing speed is observed. According to the experiments by the present inventors, totally the same fixing characteristic could be obtained at speeds from 50 mm/sec to 500 mm/sec.

Further, the toner of the present invention is specifically smaller in dependency on fixing pressure. Pressure fixing, which effects fixing by pressure, is dependent on pressure as a matter of course and the toner of the prior art was greately changed in fixing force depending on the pressure. Whereas, the pressure fixing device is not alway subjected to the constant pressure, but the fixing pressure will vary with, for example, various paper sizes. Moreover, pressure may be sometimes intentionally changed for the purpose of, for example, preventing formation of creases. When a toner of the prior art is provided for use in such a system, fixing is effected undesirably to different extents varying from place to place on the paper.

The toner of the present invention is free from such a phenomenon due to small dependency of the fixing force on the pressure.

Another extremely great specific feature of the present invention is small fixing inhibiting effect of this composition even when combined with other non-fixing components.

Also, in the case of using a pressure fixing component of the prior art, a pigment, a charge controller or an antiblocking agent may sometimes be added therein, if desired. However, in such a case, the composition of the prior art always suffered from extreme lowering in fixing characteristic when even a very little amount of such non-fixing components are incorporated therein. Whereas, these components have very little effect on the binder resin composition of the present invention, and therefore any of various additives or working agents may be used as desired without concern about its effect on the fixing characteristic. And, this indicates that the binder resin composition of the present invention is useful not only as the pressure-fixable material as such, but also for uses such as the core material in the case of encapsulated toner.

The toner particles (as a core particle) as prepared above are coated with a shell-forming resin to provide an encapsulated pressure fixable toner. Such encapsulation is preferred for obtaining a toner well balanced in developing characteristic and fixing characteristic and also well balanced in off-set resistance and fixing characteristic, and further for obtaining a toner with good storage stability.

As the sheel materials, known resins may be available, including homopolymers of styrene and substituted derivative thereof such as polystyrene, poly-p-chlorostyrene, polyvinyltoluene and the like; styrene copolymers such as styrene-p-chlorostyrene copolymer, styrene-propylene copolymer, styrene-vinyltoluene copolymer, styrene-vinylnaphthalene copolymer styrene-methyl methacrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and the like; polymethyl methacrylate; polybutyl methacrylate; polyvinyl chloride; polyvinyl acetate; polyethylene; polypropylene, polyester; polyurethane; polyamide; epoxy resin; polyvinyl butyral; rosin; modified rosin; terpene resin; phenol resin; aliphatic or alicyclic hydrocarbon resin; aromatic petroleum resin; urea resin; melamine resin; and so on. These resins may be used either singly or as a mixture.

Any microencapsulation method known in the art may be applicable. For example, there may be employed the spray drying method, the drying-in-liquid method, the phase separation method and the in-situ polymerization method. A multi-layer shell structure may also be provided in order to impart insulating property and appropriate triboelectric charging characteristic to the toner of the present invention.

Further, the encapsulated toner can contain various dyes, pigments and magnetic powder, which may be incorporated in either one or both of the core material and the shell material.

The toner of the present invention obtained after a series of the steps as described above has a mean particle size generally in the range from 3 to 30μ, and it is suitable for the shell material in the case of microcapsule to have a thickness of about 0.001 to 1μ.

Further, as described above, the present invention provides a toner which is characterized by containing a compound B having an amino group together with a hydrocarbon chain in combination with a compound A having a hydrocarbon chain. Thus, since the toner of the present invention contains the above compound B, it can strengthen the pressure fixability of the compound A having a hydrocarbon chain to enhance developing characteristic and can improve an anti-friction property of the fixed toner image on the sheet. Such a compound containing an amino group is higher in adhesion to paper or other substrates, as compared with a compound containing only a hydrocarbon chain. This may be attributable to excellent affinity of such a compound containing an amino group for affinity as well as the action of some adhesive force therebetween and anti-friction property of the fixed toner image on the sheet. Also, such a compound having an amino group is higher in developing characteristic as compared with the compound having only a hydrocarbon chain. This may be attributable to excellent stability of charges in such a compound.

Having described the basic and characteristic features of the present invention, the present invention is now illustrated specifically by referring to the following Examples, wherein parts are parts by weight.

EXAMPLE 1

| Example 1 | |
|---|---|
| Hiwax 200 P (Mitsui Petrochemical Industries, Ltd.) polyethylene wax | 200 parts |
| N—stearyl-trimethylene-diamine | 0.2 part |
| Magnetite | 60 parts |

The above materials were blended and molten, followed by mixing thoroughly by means of a kneader to prepare a homogeneous dispersion. Then, after cooling, the mixture was crushed by means of a crushing device utilizing jet air stream and further classified by a wind force classifier. The particles obtained had an average length of 8.3μ and a volume average size of 10.5μ. The toner obtained was mixed with 0.8% of a hydrophobic silica and applied to a copying machine NP-120 produced by Canon K.K. in which a fixing pressure was controlled at 14 kg/cm. As the result, good images could be obtained with sufficient fixing. No change of image was observed after successive copying of 3000 sheets.

COMPARATIVE EXAMPLE 1

In the above Example, N-stearyl-trimethylenediamine was omitted and following otherwise the same procedure, a toner was prepared. Performance of this toner was compared with that in Example 1. As the result, image density was found to be low and substantially no image appeared after 1500 sheets of copying. This toner was inhomogeneous and some toner particles contained substantially no pigment dispersed therein.

EXAMPLE 2

| Example 2 | |
|---|---|
| Sunwax (Polyethylene wax mfd. by Sanyo Kasei K. K.) | 50 parts |
| Paraffin (70° C.) | 50 parts |
| N—myristyl-trimethylenediamine | 0.2 part |
| Phtalocyanine Blue | 10 parts |

After the above mixture was mixed by melting, the molten mixture was added into a melting bath equipped with a stirring means maintained at 95° C., followed by stirring at 9000 rpm for 30 minutes, to obtain particles with an average size of 10μ. The particles are dipped in a 20% solution of polystyrene (Mn about 10000–30000) in toluene and dried by a spray drier to obtain a capsule toner. The pigments were found to be homogeneously dispersed. A mixture of 10 parts of the toner obtained and 80 parts of a carrier of reduced iron powder (EFV 250/400 mfd. by Nihon Teppun K.K.) was used for development. As the result, clear images could be obtained and the image quality was not changed even after successive copying of 1500 sheets.

EXAMPLE 3

Into a 2-1 flask was charged 800 ml of xylene, which was heated to 70° C. in an oil bath, and then 200 g of fine powder of paraffin wax (m.p. 70° C.) was added thereto, followed by stirring, to be dissolved therein. To the resultant solution were added 50 g of a monomer mixture of styrene/dimethylaminoethyl methacrylate (10/90), 0.25 g of benzoyl peroxide and 0.05 g of t-dodecylmercaptan. After replacement with nitrogen, polymerization reaction was carried out at 80° C. for one hour, at 120° C. for 3 hours and at 140° C. for 2 hours. After completion of the reaction, the reaction product was separated by pouring into an excessive amount of methanol, washed and dried. The yield was 128.3 g.

A mixture of 80 parts of the copolymer obtained and 20 parts of a polyethylene wax was further mixed with 5 parts of Phthalocyanine Blue, then melted and mixed by a heated attritor. The kneaded product was left to cool, coarsely crushed by a cutter mill, crushed by a micropulverizer utilizing jet air stream and further subjected to classification by means of a wind force classifier to obtain fine particles of a pressure-fixable toner with diameters of 10 to 20μ. The fine particles were applied to a developing device having a sleeve to develop a latent image having positive electrostatic charges, and the developed image was transferred onto a wood-free paper. The transfer paper having the image was passed through a pressure fixing device comprising two pressure rollers arranged so as to apply pressurizing force at the both ends. As the result, substantially complete fixing characteristic was exhibited at a line speed of 125 mm/sec and a line pressure of 15 kg/cm. The developed density was as good as 1.5.

EXAMPLE 4

Into an autoclave of 1-liter volume, 400 ml of water and 2 ml of polyvinyl alcohol were charged, and further 100 g of pellets of a low molecular weight polyethylene (molecular weight 1500, diameter 2 mm) were added and dispersed. To the resultant dispersion, 20 g of a monomer mixture of styrene/dimethylaminoethyl methacrylate (20/80) (containing 0.10 g of t-butyl-peroxy-benzoate as polymerization initiator and 0.05 g of t-dodecylmercaptan as molecular weight controller) was added and the mixture was stirred at 900 rpm. After replacement with nitrogen, polymerization was carried out at 80° C. for one hour, at 120° C. for 3 hours and at 140° C. for 2 hours. The dispersion state was stable. The product was washed with an aqueous hydrochloric acid solution at 80° C. and dried under reduced pressure overnight. The yield was 89.4 g. When this product was screened through a sieve of 40 mesh, 94% could be passed therethrough. 100 Parts of the graft copolymer obtained were blended with 5 parts of Phthalocyanine Blue, and the mixture was kneaded by melting on a three-roll mill. The kneaded product was left to cool, coarsely crushed by a cutter mill, crushed by a micropulverizer utilizing jet air stream and further subjected to classification by means of a wind force classifier to obtain fine particles of a pressure-fixable toner with diameters of 10 to 20μ. The fine particles were applied to a developing device having a sleeve to develop a latent image having positive electrostatic charges, and the developed image was transferred onto a wood-free paper. The transfer paper having the image was passed through a pressure fixing device comprising two pressure rollers arranged so as to apply pressurizing force at the both ends. As the result, substantially complete fixing characteristic was exhibited at a line speed of 125 mm/sec and a line pressure of 15 kg/cm. The developed density was as good as 1.5. When the same fixing test was conducted at speeds increased to 2-fold and 3-fold, respectively, the fixing characteristic was not changed at all.

When successive copying was conducted under the condition where toner can be supplemented, images could be obtained without any change when copying was continued for 3000 sheets.

EXAMPLE 5

The reaction was conducted under the same conditions as in Example 3, except for changing the monomer to N-phenyl-N'-methylaminoethyl methacrylate, carrying out polymerization at 120° C. for 3 hours and at 140° C. for 2 hours, and using as the base compound a mixture of 30 parts of a low molecular weight polyethylene wax (molecular weight 700, size 1 mm) and 70 parts of paraffin wax. The composition obtained was mixed with a quinacridone type red pigment, well kneaded on a three-roll mill, then dispersed in hot water at 90° C. and stirred at high speed to obtain particles. These particles were separated from the liquid, dried and provided for use as a toner similarly as in Example 4. Its performance was satisfactory.

EXAMPLE 6

The reaction was carried out according the same procedure as in Example 3, except for changing the monomer to N,N-diethyl-aminoethyl methacrylate, carrying out polymerization at 130° C. and at 140° C. for 2 hours and using as the base compound a mixture of paraffin wax and carnauba wax. The composition obtained was mixed with a disazo type red pigment, well kneaded on a three-roll mill, then dispersed in hot water at 90° C. and stirred at high speed to obtain particles. These particles were separated from the liquid, dried and provided for use as a toner similarly as in Example 3. As the result, satisfactory performance was exhibited similarly as in Example 3.

EXAMPLE 7

Into a 2-l flask was charged 800 ml of xylene, which was heated to 70° C. in an oil bath, and then 250 g of fine powder of polyethylene wax (m.p. 120° C.) was added thereto, followed by stirring, to be dissolved therein. To the resultant solution were added 15 g of a monomer of dimethylaminoethyl methacrylate 0.1 g of dicumyl peroxide and 0.01 g of t-dodecylmercaptan. After replacement with nitrogen, polymerization reaction was carried out at 80° C. for one hour and at 130° C. for 5 hours. After completion of the reaction, the reaction product was separated by pouring into an excessive amount of methanol, washed and dried. The yield was 128.3 g.

A mixture of 30 parts of the graft copolymer obtained and 70 parts of a paraffin wax (Pf 155, m.p. 70° C.) was further mixed with 80 parts of magnetic particles, then melted and mixed by a heated attritor to obtain a kneaded mixture.

On the other hand, 8 g of fine particulate silica (Aerosil 200, particle size 12 mμ, specific surface are 200 $m^2/g$), was charged into a 2l-glass vessel and 500 ml of distilled water was added thereto. The resultant mixture was heated to 95° C. under stirring by means of TK homomixer at 2000 rpm. Into this mixture was thrown 25 g of the kneaded mixture, followed further by stirring at an increased rotational speed of 6000 rpm for 90 minutes. Then, after throwing the dispersion into 1l of cold water, the product was filtered and dried to obtain fine particles. The fine particles obtained were dispersed in a 5% solution of a styrene/diethylaminoethyl methacrylate copolymer (Mn. about 10000 to 30000) dissolved in DMF and resin coating was applied through phase separation on the surfaces of the fine particles by adding water into the disper- sion.

The coated particles as an encapsulated toner were found to have substantially the same particle size distribution and the uniform coating was confirmed by the observation through an electronic microscope.

Next, 100 parts of the encapsulated toner were mixed with 1 part of hydrophobic microparticulate silica to provide a developer, which was employed for development of an electrostatic latent image on a photoconductive member to give a very clear image. Then, the toner image was transferred onto paper and passed through a fixing machine under a line pressure of 14 kg/cm, whereby the image was completely fixed.

The fixed image was then subjected to an abrasion resistance test as follows. Thus, the obtained fixed image was rubbed with paper while a load of 5 kg/cm was applied thereto. The abrasion resistance was measured in terms of a ratio of $d_1/d_0 \times 100$, wherein $d_0$ was an image density before rubbing and $d_1$ was an image density after rubbing. The ratio was measured to be 85% and the fixed image was found to have a sufficient abrasion resistance.

The enccapsulated pressure-fixable toner as abtained above according to the present invention was then subjected to a 10000 sheets of successive copying test, whereby the image quality was maintained good even after the 10000 sheets of copying without change from that in the initial stage. Substantial change in developing perfomance of the toner was not found even under different environmental conditions.

EXAMPLE 8

A pressure-fixable toner in the form of fine particles was obtained in the same manner as in Example 3 except that a mixture of 30 parts of the graft copolymer and 70 parts of polyethylene wax was used. The thus obtained pressure-fixable toner was found to have an excellent developing performance and was satisfactorily fixed at a low line pressure of 14 kg/cm.

EXAMPLE 9

Into a 2-1 flask was charged 800 ml of xylene, which was heated to 70° C. in an oil bath, and then 200 g of fine powder of paraffin wax (m.p. 70° C.) was added thereto, followed by stirring, to be dissolved therein. To the resultant solution were added 15 g of a monomer of dimethylaminoethyl methacrylate 0.25 g of benzoyl peroxide and 0.05 g of t-dodecylmercaptan. After replacement with nitrogen, polymerization reaction was carried out at 80° C. for one hour, at 120° C. for 3 hours and at 140° C. for 2 hours. After completion of the reaction, the reaction product was separated by pouring into an excessive amount of methanol, washed and dried. The yield was 110 g.

A mixture of 20 parts of the graft copolymer obtained and 100 parts of a polyethylene wax was further mixed with 5 parts of Phthalocyanine Blue, then melted and mixed by a heated attritor. The kneaded product was left to cool, coarsely crushed by a cutter mill, crushed by a micropulverizer utilizing jet air stream and further subjected to classification by means of a wind force classifier to obtain fine particles of a pressure fixable toner with diameters of 10 to 20μ. The fine particles were applied to a developing device having a sleeve to develop a latent image having positive electrostatic charges, and the developed image was transferred onto a wood-free paper. The transfer paper having the image was passed through a pressure fixing device comprising two pressure rollers arranged so as to apply pressurizing force at the both ends. As the result, substantially complete fixing characteristic was exhibited at a line speed of 125 mm/sec and a line pressure of 14 kg/cm. The developed density was as good as 1.4.

EXAMPLE 10

Into an autoclave of 1-liter volume, 400 ml of water and 2 ml of polyvinyl alcohol were charged, and further 100 g of pellets of a low molecular weight polyethylene (molecular weight 1500, diameter 2 mm) were added and dispersed. To the resultant dispersion, 10 g of a monomer of dimethylaminoethyl methacrylate (containing 0.10 g of t-butylperoxybenzoate as polymerization initiator and 0.05 g of t-dodecylmercaptan as molecular weight controller) was added and the mixture was stirred at 900 rpm. After replacement with nitrogen, polymerization was carried out at 80° C. for one hour, at 120° C. for 3 hours and at 140° C. for 2 hours. The dispersion state was stable. The product was washed with an aqueous hydrochloric acid solution at 80° C. and dried under reduced pressure overnight. The yield was 73 g. When this product was screened through a sieve of 40 mesh, 92% could be passed therethrough. A mixture of 100 parts of paraffin wax (m.p. 75° C.) and 10 parts of the graft copolymer obtained were blended with 5 parts of Phthalocyanine Blue, and the mixture was kneaded by melting on a three-roll mill. The kneaded product was left to cool, coarsely crushed by a cutter mill, crushed by a micropulverizer utilizing jet air stream and further subjected to classification by means of a wind force classifier to obtain fine particles of a pressure-fixable toner with diameters of 10 to 20μ. The fine particles were applied to a developing device having a sleeve to develop a latent image having positive electrostatic charges, and the developed image was transferred onto a wood-free paper. The transfer paper having the image was passed through a pressure fixing device comprising two pressure rollers arranged so as to apply pressurizing force at the both ends. As the result, substantially complete fixing characteristic was exhibited at a line speed of 125 mm/sec and a line pressure of 14 kg/cm. The developed density was as good as 1.5. When the same fixing test was conducted at speeds increased to 2-fold and 3-fold, respectively. the fixing characteristic was not changed at all.

When successive copying was conducted under the condition where toner can be supplemented, images could be obtained without any change when copying was continued for 3000 sheets.

EXAMPLE 11

An encapsulated pressure-fixable toner was obtained in the same manner as in Example 7 except that the toner particles obtained in Example 9 was used as the core material.

EXAMPLE 12

An encapsulated pressure-fixable toner was obtained in the same manner as in Example 7 except that the toner particles obtained in Example 10 was used as the core material.

What is claimed is:

1. A pressure-fixable toner, comprising a compound A of $C_{12}$ or more than $C_{12}$ having an aliphatic saturated hydrocarbon chain of $C_{12}$ or more than $C_{12}$ and an amine compound $B_1$ having an alkyl group or an alkylene group of $C_{10}$ to $C_{31}$, said amine compound $B_1$ being added in an amount of 0.01 to 3.0 weight % based on said compound A and said compound A being compatible with said Compound $B_1$.

2. A pressure-fixable toner according to claim 1, wherein the amine compound $B_1$ is substantially linear.

3. A pressure-fixable toner according to claim 1, wherein the amine compound $B_1$ is obtained by reacting a primary amine having an alkyl group of $C_{10}$ to $C_{31}$ with acrylonitrile and further hydrogenating the reaction product.

4. A pressure-fixable toner according to claim 2, wherein the amine compound $B_1$ is a compound selected from the groups consisting of compounds represented by the following formulae $R_1—NH_2$, $NH_2—R_2—NH_2$, $R'NH—R_2—NH_2$, $R_1—NH—R_3$, $R''(R_2—NH)_mR'''$ and $R_a—NH—(CH_2)b—NH_2$ wherein $R_1$: $(CH_2)_n$, $CH_3$, $n_1=9$ to 30

Ra: $CH_3(CH_2)_n$, $n_4=9$ to 17, b=3 or 4;

$R_2$: $(CH_2)n_2$, $n_2=10$ to 30;

$R_3$: $(CH_2)n_3$ $CH_3$, $n_3=1$ to 30;

m: 1 or more than 1

R', R'' and R''': alkyl group, polybutenyl group or polybutenyl succinic acid group.

5. A pressure-fixable toner according to claim 4, wherein an amine compound $B_1$ is N-stearyl-trimethylenediamine or N-myristyl-trimethylene-diamine.

6. A pressure-fixable toner, comprising 100 parts by weight of a compound A of $C_{12}$ or more than $C_{12}$ having an aliphatic saturated hydrocarbon chain of $C_{12}$ or more than $C_{12}$ and more than 10 parts by weight of a compound $B_2$ having a hydrocarbon chain and an amino group, said compound $B_2$ being obtained by graft copolymerizing a compound having an aliphatic saturated hydrocarbon chain of $C_{12}$ or more than $C_{12}$ with an amino group-containing monomer represented by the following formula

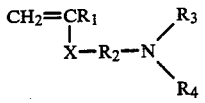

wherein

X: —COO— or —O—

$R_2$: a lower alkylene having 1 to 5 carbon atoms;

$R_1$: hydrogen or a lower alkyl having 1 to 5 carbon atoms;

$R_3$, $R_4$: hydrogen, a lower alkyl having 1 to 5 carbon atoms or a phenyl group;

wherein compound A is compatible with compound $B_2$.

7. A pressure-fixable toner according to claim 6, wherein the compound $B_2$ is obtained by graft polymerizing 100 parts by weight of the compound having an aliphatic saturated hydrocarbon chain of $C_{12}$ or more than $C_{12}$ with 0.1 to 20 parts by weight of the amino group-containing monomer.

8. A pressure-fixable toner according to claim 6, wherein the compound $B_2$ is obtained by graft polymerizing the compound having an aliphatic saturated hydrocarbon chain of $C_{12}$ or more than $C_{12}$ with a monomer mixture of the amino group-containing monomer and a vinyl monomer.

9. A pressure-fixable toner according to claim 8, wherein the amino group-containing monomer is contained in an amount of more than 20% by weight in the monomer mixture.

10. A pressure-fixable toner according to claim 6, wherein the amino group-containing monomer is dimethylaminoethyl methacrylate, N-phenyl-N'-methylaminoethyl methacrylate or N,N-diethylaminoethyl methacrylate.

11. A pressure-fixable toner according to claim 6, wherein the compound having an aliphatic saturated hydrocarbon chain of $C_{12}$ or more than $C_{12}$ is paraffin wax, polyethylene or a mixture of paraffin wax and carnauba wax.

12. A pressure-fixable toner, comprising a compound $B_2$ obtained by graft copolymerizing a compound having an aliphatic saturated hydrocarbon chain of $C_{12}$ or more than $C_{12}$ with an amino group-containing monomer represented by the following formula

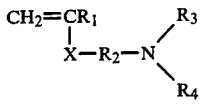

wherein:

X: —Coo— or —O—

$R_2$: a lower alkylene having 1 to 5 carbon atoms;

$R_1$: hydrogen or a lower alkyl having 1 to 5 carbon atoms;

$R_3$, $R_4$: hydrogen, a lower alkyl having 1 to 5 carbon atoms or a phenyl group.

13. An encapsulated pressure-fixable toner, comprising a core and a shell encapsulting said core in which said core comprises a compound A of $C_{12}$ or more than $C_{12}$ having an aliphatic saturated hydrocarbon chain of $C_{12}$ or more than $C_{12}$ and an amine compound $B_1$ having an alkyl group or an alkylene group of $C_{10}$ to $C_{31}$, said amine compound $B_1$ being added in an amount of 0.01 to 3.0 weight % based on said compound A and said compound A being compatible with said compound $B_1$.

14. An encapsulated pressure-fixable toner according to claim 13, wherein the core has a mean particle size 3 to 30 $\mu$ and the shell has a thickness of 0.001 to 1$\mu$.

15. An encapsulated pressure-fixable toner according to claim 13, wherein the amine compound $B_1$ is substantially linear.

16. An encapsulated pressure-fixable toner according to claim 13, wherein the amine compound $B_1$ is obtained by reacting a primary amine having an alkyl group of $C_{10}$ to $C_{31}$ with acrylonitrile and further hydrogenating the reaction product.

17. A pressure-fixable toner according to claim 15, wherein the amine compound $B_1$ is a compound selected from the group consisting of compounds represented by the following formulae $R_1$—NH2, $NH_2$—$R_2$—$NH_2$,

R'NH—$R_2$—$NH_2$, $R_1$—NH—$R_3$,

R''$(R_2$—NH$)_m$R''' and $R_a$—NH—$(CH_2)_b$—$NH_2$ wherein $R_1$: $(CH_2)n_1CH_3$, $n_1=9$ to 30

$R_2$: $(CH_2)n_2$, $n_2=10$ to 30

$R_3$: $(CH_2)n_3CH_3$, $n_3=1$ to 30 m: 1 or more than 1

R', R'' and R''': alkyl group, polybutenyl group or polybutenyl succinic acid group; and $R_a$: $(CH_2)n_4$—$CH_3$, $n_4=9$–17, b=3 or 4.

18. An encapsulated pressure-fixable toner according to claim 17, wherein an amine compound $B_1$ is N-stearyl-trimethylene-diamine or N-myristyltrimethylene-diamine.

19. An encapsulated pressure-fixable toner, comprising a core and a shell encapsulating said core, in which said core comprises 100 parts by weight of a compound A or $C_{12}$ or more than $C_{12}$ having an aliphatic saturated hydrocarbon chain of $C_{12}$ or more than $C_{12}$ and more than 10 parts by weight of a compound $B_2$ said compound $B_2$ being obtained by graft copolymerizing a compound having an aliphatic saturated hydrocarbon chain of $C_{12}$ or more than $C_{12}$ with an amino group-containing monomer represented by the following formula

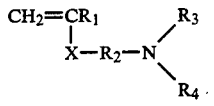

wherein:

X: —COO— or —O—;

$R_2$: a lower alkylene having 1 to 5 carbon atoms;

$R_1$: hydrogen or a lower alkyl having 1 to 5 carbon atoms;

$R_3$, $R_4$: hydrogen, a lower alkyl having 1 to 5 carbon atoms or a phenyl group;

wherein said compound A is compatible with compound $B_2$.

20. An encapsulated pressure-fixable toner according to claim 19, wherein the core has a mean particle size of 3 to 30 $\mu$ and the shell has a thickness of 0.001 to 1$\mu$.

21. An encapsulated pressure-fixable toner according to claim 19, wherein the compound $B_2$ is obtained by graft polymerizing 100 parts by weight of the compound having an aliphatic saturated hydrocarbon chain of $C_{12}$ or more than $C_{12}$ with 0.1 to 20 parts by weight of the amino group-containing monomer.

22. An encapsulated pressure-fixable toner according to claim 19, wherein the compound $B_2$ is obtained by graft polymerizing the compound having an aliphatic hydrocarbon chain of $C_{12}$ or more than $C_{12}$ with a monomer mixture of the amino group-containing monomer and a vinyl monomer.

23. An encapsulated pressure-fixable toner according to claim 22, wherein the amino group-containing monomer is contained in an amount of more than 20% by weight in the monomer mixture.

24. An encapsulated pressure-fixable toner according to claim 19, wherein the amino group-containing monomer is dimethylaminoethyl methacrylate, N-phenyl-N'-methylaminoethyl methacrylate or N,N-diethylaminoethyl methacrylate.

25. An encapsulated pressure-fixable toner according to claim 19, wherein the compound having an aliphatic saturated hydrocarbon chain of $C_{12}$ or more than $C_{12}$ is paraffin wax, polyethylene or a mixture of paraffin wax and carnauba wax.

26. An encapsulated pressure-fixable toner, comprising a core and a shell encapsulating said core, in which said core comprises compound $B_2$ obtained by graft copolymerizing a compound having an aliphatic saturated hydrocarbon chain of $C_{12}$ or more than $C_{12}$ with an amino group-containing monomer represented by the following formula

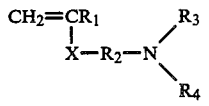

wherein:

X: —COO— or —O—;

$R_2$: a lower alkylene having 1 to 5 carbon atoms;

$R_1$: hydrogen or a lower alkyl having 1 to 5 carbon atoms;

$R_3$, $R_4$: hydrogen, a lower alkyl having 1 to 5 carbon atoms or a phenyl group.

27. A pressure-fixable toner according to claim 1, wherein the compound A is a compound selected from the group consisting of aliphatic saturated hydrocarbons, fatty acids, fatty esters, metal soaps of fatty acid, fatty alcohols, polyvalent alcohols and metal salts thereof or chlorides thereof, fluorides thereof, amides thereof, bisamides thereof, polymers and copolymers having the same structures in the structural units, polyolefine, polyethylene, polypropylene, paraffin wax, microcrystalline wax, montan wax, ceresin wax, ozocerite, carnauba wax, rice wax, shellac wax, Sazol wax, metal soap, and amide wax.

28. A pressure-fixable toner according to claim 27, wherein the compound A is a compound selected from the group consisting of polyethylene, polypropylene, paraffin wax, microcrystalline wax, montan wax, ceresin wax, ozocerite, carnaube wax, rice wax, shellac wax, Sazol wax, metal soap and amide wax.

29. A pressure-fixable toner according to claim 6, wherein the compound A is a compound selected from the group consisting of aliphatic saturated hydrocarbons, fatty acids, fatty esters, metal soaps of fatty acid, fatty alcohols, polyvalent alcohols and metal salts thereof or chlorides thereof, fluorides thereof, amides thereof, bisamides thereof, polymers and copolymers having the same structures in the structural units, polyolefine, polyethylene, polypropylene, paraffin wax, microcrystalline wax, montan wax, ceresin wax, ozocerite, carnauba wax, rice wax, shellac wax, Sazol wax, metal soap, and amide wax.

30. A pressure-fixable toner according to claim 29, wherein the compound A is a compound selected from the group consisting of polyethylene, polypropylene, paraffin wax, microcrystalline wax, montan wax, ceresin wax, ozocerite, carnauba wax, rice wax, shellac wax, Sazol wax, metal soap, and amide wax.

31. A pressure-fixable toner according to claim 19, wherein the compound A is a compound selected from the group consisting of aliphatic saturated hydrocarbons, fatty acids, fatty esters, metal soaps of fatty acid, fatty alcohols, polyvalent alcohols and metal salts thereof or chlorides thereof, fluorides thereof, amides thereof, bisamides thereof, polymers and copolymers having the same structures in the structural units, polyolefine, polyethylene, polypropylene, paraffin wax, microcrystalline wax, montan wax, ceresin wax, ozocerite, carnaube wax, rice wax, shellac wax, Sazol wax, metal soap, and amide wax.

32. A pressure-fixable toner according to claim 29, wherein the compound A is a compound selected from the group consisting of polyethylene, polypropylene, paraffin wax, microcrystalline wax, montan wax, ceresin wax, ozocerite, carnaube wax, rice wax, shellac wax, Sazol wax, metal soap and amide wax.

* * * * *